US009790653B2

(12) United States Patent
Thompson et al.

(10) Patent No.: US 9,790,653 B2
(45) Date of Patent: Oct. 17, 2017

(54) ENERGY ABSORBING VEHICLE BARRIER

(71) Applicant: Energy Absorption Systems, Inc., Dallas, TX (US)

(72) Inventors: Sean Thompson, Sacramento, CA (US); Aaron J. Cox, Roseville, CA (US); Patrick A. Leonhardt, Rocklin, CA (US)

(73) Assignee: Energy Absorption Systems, Inc., Dallas, TX (US)

( * ) Notice: Subject to any disclaimer, the term of this patent is extended or adjusted under 35 U.S.C. 154(b) by 524 days.

(21) Appl. No.: 13/905,947

(22) Filed: May 30, 2013

(65) Prior Publication Data

US 2013/0266369 A1 Oct. 10, 2013

Related U.S. Application Data

(63) Continuation of application No. 12/760,748, filed on Apr. 15, 2010, now Pat. No. 8,469,626.

(51) Int. Cl.
*E01F 15/14* (2006.01)
*E01F 15/02* (2006.01)

(52) U.S. Cl.
CPC ..... *E01F 15/146* (2013.01); *E01F 15/02* (2013.01); *E01F 15/145* (2013.01); *Y10T 29/49826* (2015.01)

(58) Field of Classification Search
USPC ..... 404/6, 8; 256/13.1
See application file for complete search history.

(56) References Cited

U.S. PATENT DOCUMENTS

| | | | | |
|---|---|---|---|---|
| 3,674,115 | A | 7/1972 | Young et al. | |
| 3,944,187 | A | 3/1976 | Walker | |
| 4,007,917 | A * | 2/1977 | Brubaker | 256/13.1 |
| 4,321,989 | A | 3/1982 | Meinzer | |
| 4,352,484 | A | 10/1982 | Gertz et al. | |

(Continued)

FOREIGN PATENT DOCUMENTS

| | | | |
|---|---|---|---|
| CN | 2264203 | Y | 10/1997 |
| CN | 201155092 | Y | 11/2008 |

(Continued)

OTHER PUBLICATIONS

International Search Report and Written Opinion of the International Searching Authority for International Application No. PCT/US2011/032019, dated Jun. 27, 2011, 4 pages.

(Continued)

*Primary Examiner* — Abigail A Risic
(74) *Attorney, Agent, or Firm* — Brinks Gilson & Lione

(57) ABSTRACT

An energy absorbing vehicle barrier includes a frame defining a compartment. In one embodiment, the frame includes a nose. An energy absorbing cartridge is disposed within the compartment. A retaining device is coupled to the frame, with the retaining device disposed above and extending over at least a portion of an upper surface of the cartridge. The retaining device may contact and engage the upper surface of the cartridge when the barrier is impacted by a vehicle. In this way, the retaining device substantially prevents movement of the cartridge in at least a vertical direction during the impact. Methods of using and assembling the barrier are also provided.

21 Claims, 9 Drawing Sheets

(56) References Cited

U.S. PATENT DOCUMENTS

| | | | | |
|---|---|---|---|---|
| 4,583,716 | A | 4/1986 | Stephens et al. | |
| 4,674,911 | A | 6/1987 | Gertz | |
| 4,770,420 | A * | 9/1988 | Gottwald et al. | 293/104 |
| 5,011,326 | A | 4/1991 | Carney, III | |
| 5,052,732 | A | 10/1991 | Oplet et al. | |
| 5,248,129 | A | 9/1993 | Gertz | |
| 5,642,792 | A | 7/1997 | June | |
| 5,700,106 | A | 12/1997 | Young et al. | |
| 5,733,062 | A | 3/1998 | Oberth et al. | |
| 5,868,521 | A | 2/1999 | Oberth et al. | |
| 6,076,871 | A | 6/2000 | Jarvis et al. | |
| 6,481,920 | B1 | 11/2002 | Leonhardt et al. | |
| 6,579,034 | B1 | 6/2003 | Welch et al. | |
| 6,623,204 | B2 * | 9/2003 | Buehler | 404/6 |
| 6,905,281 | B2 | 6/2005 | Kang | |
| 7,396,184 | B2 | 7/2008 | Laturner et al. | |
| 7,481,600 | B2 | 1/2009 | Barton | |
| 7,484,906 | B2 | 2/2009 | Laturner et al. | |
| 7,621,510 | B2 | 11/2009 | Gibbs et al. | |
| 7,874,572 | B2 | 1/2011 | Buehler et al. | |
| 8,016,513 | B2 * | 9/2011 | Shin | 404/6 |
| 8,136,830 | B2 | 3/2012 | Buehler et al. | |
| 2003/0113160 | A1 * | 6/2003 | Welch et al. | 404/6 |
| 2003/0210954 | A1 | 11/2003 | Kang | |
| 2003/0215285 | A1 | 11/2003 | Leonhardt et al. | |
| 2004/0025451 | A1 | 2/2004 | Barton | |
| 2004/0156677 | A1 | 8/2004 | Gelfand et al. | |
| 2007/0235706 | A1 | 10/2007 | Barton | |
| 2007/0286675 | A1 * | 12/2007 | Kennedy et al. | 404/6 |
| 2009/0129860 | A1 | 5/2009 | Laturner et al. | |
| 2010/0080652 | A1 | 4/2010 | Shin | |
| 2011/0091273 | A1 * | 4/2011 | Sayre et al. | 404/6 |

FOREIGN PATENT DOCUMENTS

| | | |
|---|---|---|
| DE | 2147616 | 3/1972 |
| GB | 2 083 162 | 3/1982 |
| JP | 7186951 A | 7/1995 |
| JP | 2003-064629 | 3/2003 |
| JP | 2005-163267 | 6/2005 |
| WO | WO 03/095247 A1 | 11/2003 |

OTHER PUBLICATIONS

Extended (Supplementary) European Search Report in European Application No. 11 76 9394.5 dated Sep. 13, 2016, 8 pages.

* cited by examiner

ENERGY ABSORBING VEHICLE BARRIER

This application is a continuation of U.S. application Ser. No. 12/760,748, filed Apr. 15, 2010, the entire disclosure of which is hereby incorporated herein by reference.

BACKGROUND

Field of the Invention

The present invention generally relates to a vehicle barrier, and in particular, a vehicle barrier capable of absorbing energy of an impacting vehicle in a non-lethal manner.

Technical Background

Energy absorbing vehicle barriers, such as highway crash cushions, are typically used alongside highways in front of obstructions such as concrete walls, toll booths, tunnel entrances, bridges and the like. One type of crash cushion utilizes a plurality of energy absorbing elements disposed within an array of diaphragms and an array of fender panels extending alongside the diaphragms. In the event of an axial impact, the crash cushion is designed to absorb the kinetic energy of an impacting vehicle as the crash cushion collapses in the axial or longitudinal direction. As the crash cushion collapses, the diaphragms move closer to one another and the fender panels telescope over one another, which causes the energy absorbing elements disposed within the diaphragms to compress and deform, thereby absorbing the kinetic energy of the impacting vehicle. After such a collision, many of the component parts can be reused by repositioning the diaphragms and the fender panels in their original position, and replacing the energy absorbing elements and other damaged components. Typically, the energy absorbing elements are not restrained in the vertical direction for ease of assembly and rehabilitation.

BRIEF SUMMARY

In one aspect, one embodiment of an energy absorbing vehicle barrier includes a frame defining a compartment, an energy absorbing cartridge disposed within the compartment and a retaining device coupled to the frame. The retaining device may be disposed above and extend over at least a portion of an upper surface of the cartridge. The retaining device is adapted to contact and engage the upper surface of the cartridge when the compartment is impacted by a vehicle such that the retaining device substantially prevents movement of the cartridge in at least a vertical direction during impact.

In one embodiment, the frame may include first and second longitudinally extending sides disposed on opposite sides of the compartment and a nose extending between the first and second sides. The retaining device may be configured as a bracket attached to the nose, with the bracket cantilevered over an upper surface of the cartridge in one embodiment.

In another embodiment, the retaining device includes first and second ends coupled to the longitudinally extending sides of the frame, including the nose in one embodiment. The retaining device extends laterally substantially across an entire width of the cartridge. In one embodiment, the retaining device may include a bar releasably coupled to the frame.

In another aspect, a method of arresting an impacting vehicle includes providing an energy absorbing vehicle barrier including at least one frame defining a compartment and an energy absorbing cartridge disposed within the compartment. A retaining device is coupled to the frame and is disposed above and extends over at least a portion of an upper surface of the cartridge. The method may also include impacting the barrier with a vehicle and restraining the cartridge in at least a substantially vertical direction during the impact such that the retaining device and the frame substantially retain the cartridge within the compartment during the impact.

In yet another aspect, a method of assembling an energy absorbing vehicle barrier includes assembling a frame to define at least one compartment, placing a cartridge within the compartment and attaching a retaining device to the frame above an upper surface of the cartridge.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

FIG. 10(*b*) is an assembled detail view of the retaining device of FIG. 10(*a*).

DETAILED DESCRIPTION OF THE DRAWINGS AND THE PRESENTLY PREFERRED EMBODIMENTS

Figure 1:
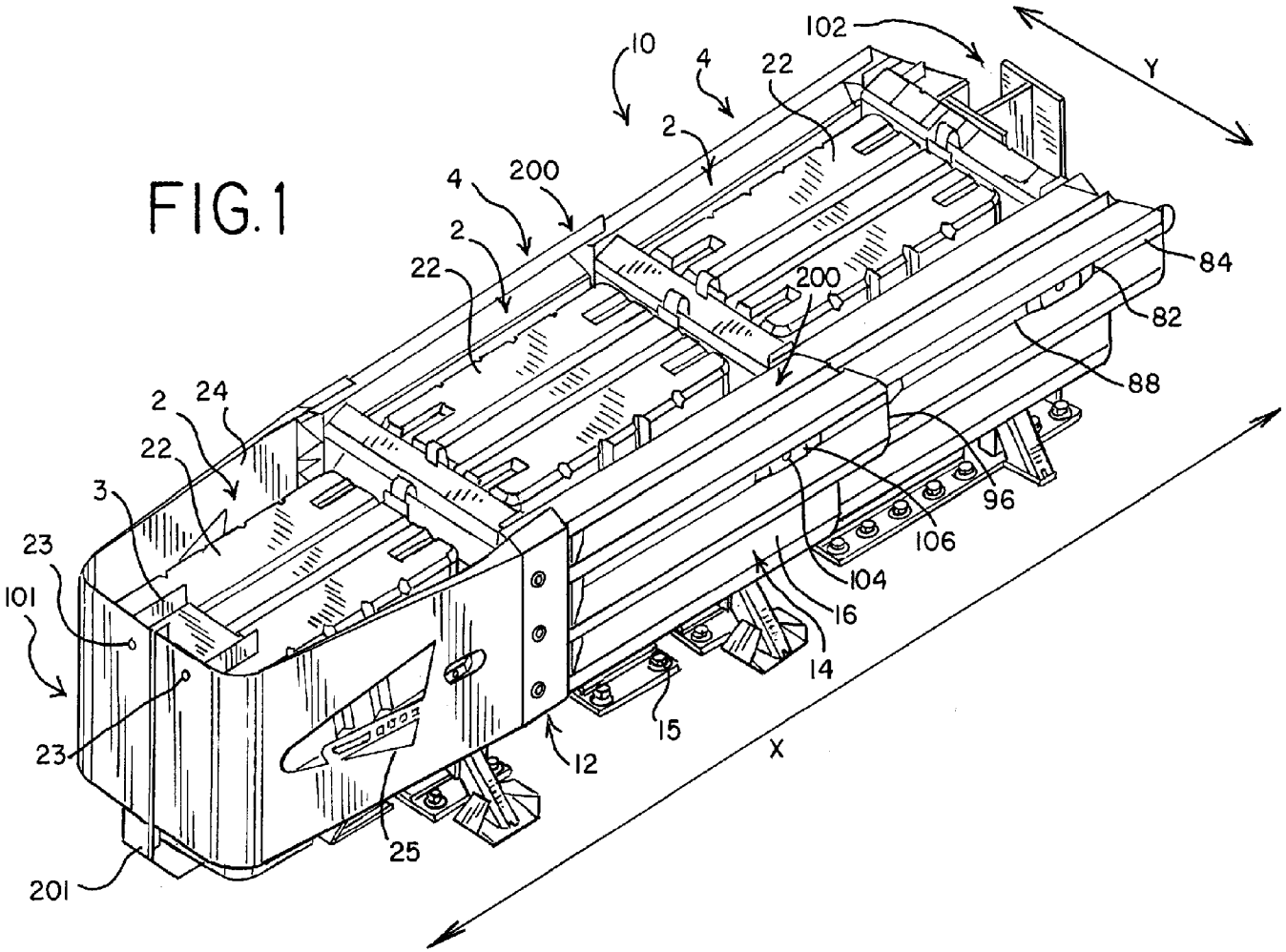
FIG. 1 is a perspective view of one embodiment of an energy absorbing vehicle barrier.

The term "lateral," "laterally," and variations thereof refer to the widthwise direction Y extending transversely between first and second fender panels 16 of an energy absorbing vehicle barrier 10. The lateral direction is substantially perpendicular to a longitudinal or axial direction X that extends from the foremost end 101 to the rearmost end 102 of the vehicle barrier 10. The term "rearward" refers to the position or orientation moving away from the nose fender 24 at one end 101 and toward an opposite end 102 of the vehicle barrier 10 positioned adjacent an obstruction or hazard, such as a bridge post, toll booth, etc. The term "upper" or "above" refers to the vertical direction or orientation towards the top most edge of the energy absorbing vehicle barrier 10, while the term "lower" or "below" refers to the vertical direction or orientation towards the ground. The term "overlapping configuration" may mean overlapping in an inside or outside configuration. Throughout this specification, like reference numbers refer to like elements.

Figure 2:
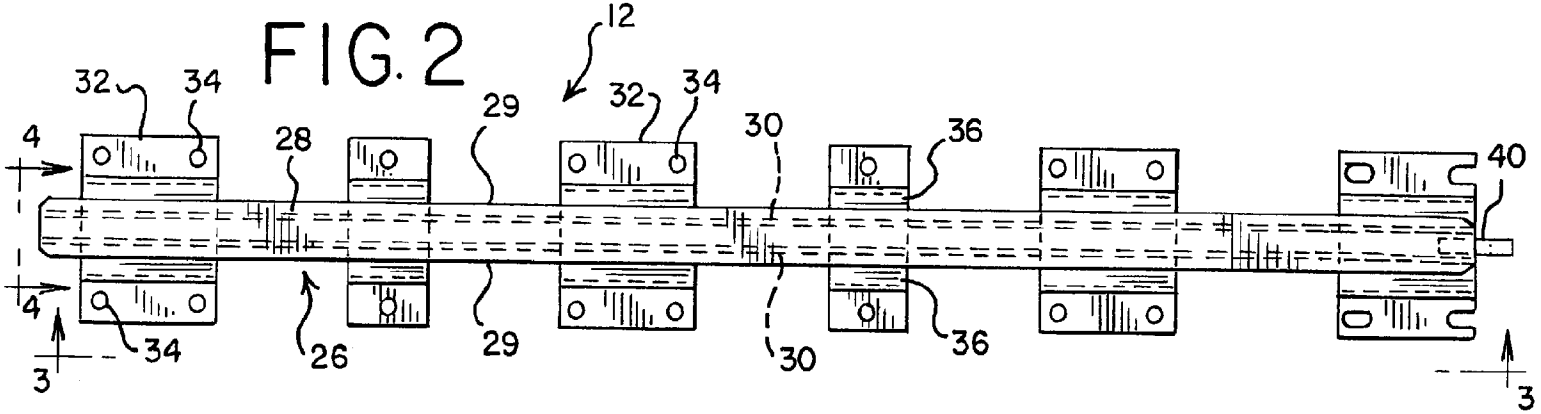
FIG. 2 is a top view of a segment of a guide rail.
Figure 3:
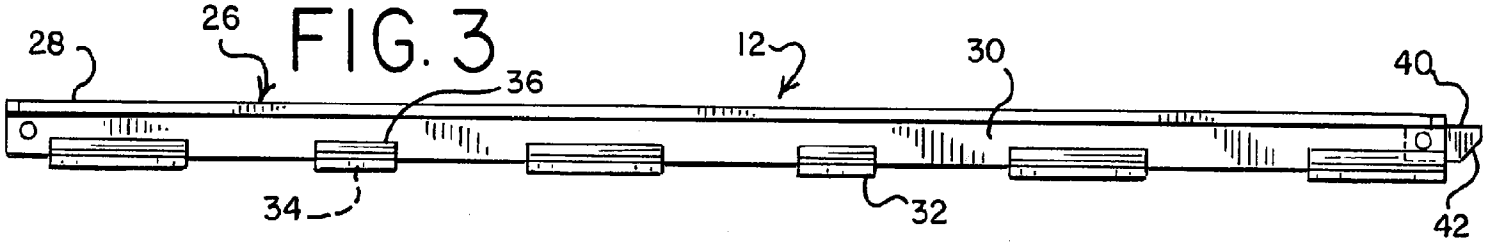
FIG. 3 is a side elevation view taken along line 3-3 of FIG. 2.
Figure 5:
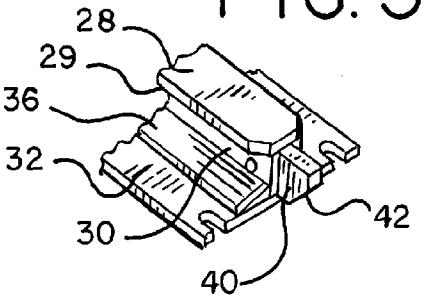
FIG. 5 is an end perspective view of the guide rail segment of FIG. 2.
Figure 4:
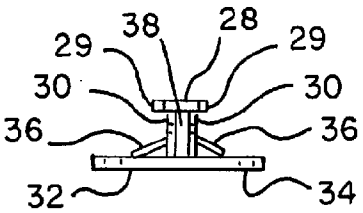
FIG. 4 is an end view taken along line 4-4 of FIG. 2.

Turning now to the drawings, FIGS. 1-7 illustrate an energy absorbing vehicle barrier 10 similar to the highway crash cushion described in U.S. Pat. No. 5,868,521, which is assigned to Energy Absorption Systems, Inc., the Assignee of the present application, and which is hereby incorporated herein by reference in its entirety. Referring to FIGS. 2-5, the energy absorbing vehicle barrier 10 of FIG. 1 may include a guide rail 12 comprising two or more segments 26. Each of the segments 26 includes an upper plate 28 and two side plates 30. The upper plate 28 forms two opposed, horizontally extending flanges 29. The side plates 30 are secured to a series of lower plates 32. Each of the lower plates 32 defines at least two openings 34 sized to receive a respective ground anchor 15. Bracing plates 36 may be secured between the side plates 30 and the lower plates 32 to provide additional rigidity. As shown in FIG. 4, one end of the segment 26 defines a central recess 38 which in this embodiment is generally rectangular in shape. As shown in FIGS. 2, 3, and 5, the other end of the segment 26 defines a central protrusion 40. The central protrusion 40 is generally rectangular in shape, but may define a sloping lower surface 42.

The upper plate 28 may be formed of, for example and without limitation, a steel plate having a width of 10 cm and a thickness of 1.3 cm. The side plates 30 may be formed of flat bar having a height of 7.6 cm and a thickness of 0.95 cm. The lower plates 32 may be 1.3 cm in thickness. A hot-rolled steel such as ASTM A-36 or AISM 1020 has been found suitable, and standard welding techniques may be used to secure the various components together. Because the guide rail 12 is segmented, it may be more easily transported and installed than a one-piece guide rail. Furthermore, in the event of damage, only the damaged segment 26 must be replaced, thereby reducing maintenance costs. The sloping lower surface 42 of the central 55 protrusion 40 and the slots in the lower plate 32 near the central protrusion 40 allow the damaged segment 26 to be removed by lifting up the end forming the central recess 38.

Figure 7:
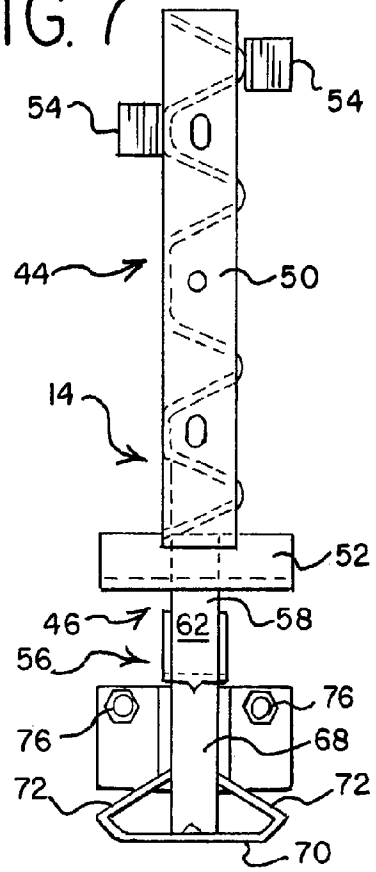
FIG. 7 is a side view of the diaphragm assembly of FIG. 6.
Figure 6:
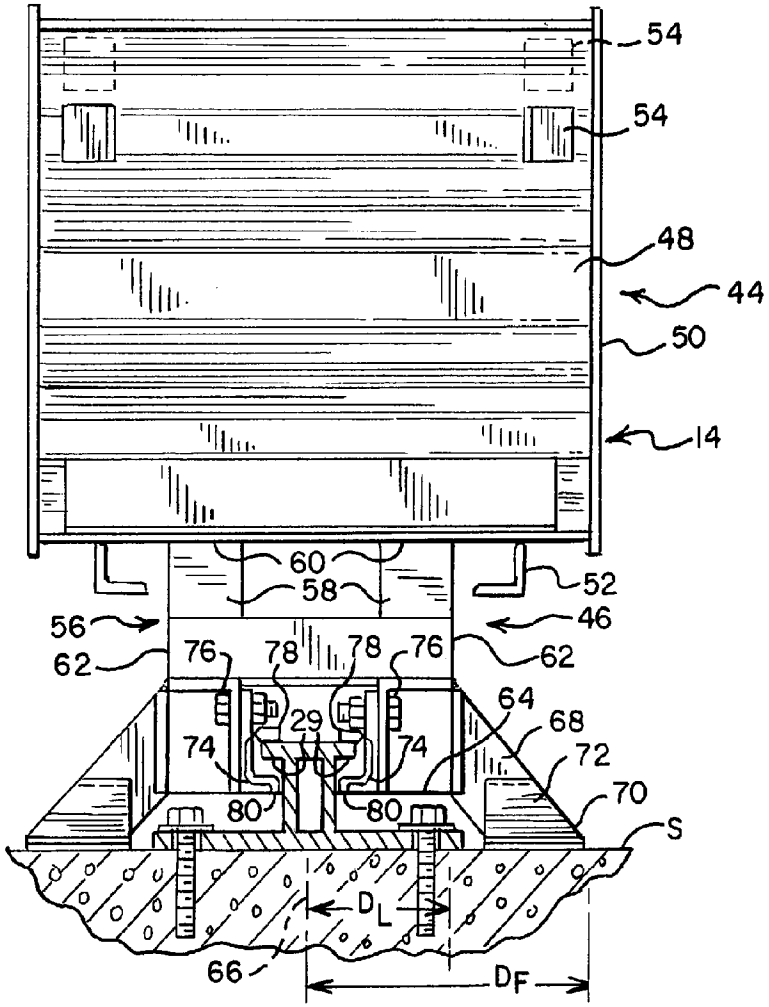
FIG. 6 is a front elevation view of a diaphragm assembly, showing the relationship between the diaphragm assembly and the guide rail.

FIGS. 6 and 7 illustrate diaphragm assemblies 14. Each diaphragm assembly 14 may include an upper part 44 and a lower part 46. The upper part 44 forms a diaphragm, and includes a central panel 48, which in this embodiment is a ridged metal plate, and may be identical in cross section to the fender panels. The panel 48 is rigidly secured at each end to a respective metal plate 50. Support brackets 52 can be secured to the lower edge of the panel 48 to support the energy absorbing elements or cartridges 22. Alignment brackets 54 can be secured to the panel 48 to locate the energy absorbing cartridges 22 laterally in the bays or nose compartment. The lower part 46 of the diaphragm assembly 14 includes a leg assembly 56. The leg assembly 56 in this embodiment 10 includes two rectangular-section legs 58 which are rigidly secured to the upper portion 44, by, for example, welding or the like. The leg assembly 56 forms an upper portion 60 that is secured to the diaphragm of the diaphragm assembly 14, two side portions 62, and a lower portion 64. The side portions 62 are symmetrically positioned with respect to a centerline 66 in the lateral, or widthwise direction of the vehicle barrier 10. In this embodiment, the centerline 66 is oriented in the vertical direction.

Each of the legs 58 supports a respective foot 68. The feet 68 extend downwardly and outwardly from the lower portion 64 of the legs 58. Each of the feet 68 terminates in a 20 lower plate 70 and a pair of side plates 72. The lower plate 70 is shaped to support the diaphragm assembly 14 on a support surface, and to slide freely along the support surface. This support surface can be formed, for example, by a concrete pad. The side plates 72 form ramps extending upwardly from the lower plate 72 to the foot 68. These ramps reduce snagging of the tire or wheel of an impacting vehicle on the lowermost portion of the foot 68. As shown in FIG. 6, two guides 74 are removably secured between the legs 58, by fasteners 76 or the like. Each of the guides 74 includes a respective pair of spaced, horizontal plates 78, 80 facing the centerline 66. The plates 78, 80 receive the flanges 29 therebetween, with the upper plates 78 resting on the upper surface of the flanges 29 and the lower plates 80 positioned to engage the lower surface of the flanges 29. During operation, the weight of the diaphragm assemblies 14 is supported by the feet 68 and the plates 78.

In operation, the plates 80 prevent the diaphragm assemblies 14 from moving upwardly with respect to the guide rail 12 during an impact with a vehicle. Because the guides 74 are held in place in the diaphragm assembly 14 by removable fasteners 76, the guides 74 can be replaced if damaged in an impact, without removing the diaphragm assemblies 14. As the vehicle barrier 10 collapses in an axial impact, the diaphragm assemblies 14 slide down the guide rail 12, while the guide rail 12 prevents substantially all lateral movement of the vehicle barrier 10. The guides 74 may have a substantial length, and can for example be 20 cm in length and approximately 1.3 cm in thickness. The guides 74 may be made from, for example, hot-rolled steel, such as ASTM A-36 or AISM 1020. The length of the guides 74 reduces any tendency of the diaphragm assemblies 14 to rock and bind to the guide rail 12 in an axial/longitudinal collapse/compression, thereby insuring a stable, consistent axial collapse of the vehicle barrier 10. Because the lower plates 80 engage the underside of the flanges 29, the lower plates 80 and the flanges 29 prevent the vehicle barrier 10 from overturning or flipping during the impact event. The upper plates 78 of the guides 74 maintain the diaphragm assemblies 14 at the proper height relative to the guide rail 12, in spite of irregularities in the support surface. The guide rail 12 and the guide 74 provide lateral restraint, guided collapse, and resistance to overturning throughout the entire axial stroke of the collapsing vehicle barrier 10. Furthermore, in the event of a side impact against the fender panels 16, the guides 74 tend to lock against the guide rail 12 as they are moved by the impacting vehicle into a position oblique to the guide rail 12. This locking action provides further lateral rigidity to the vehicle barrier 10 in a lateral impact. The wide separation between the feet 68 increases stability of the vehicle barrier 10 and resistance to overturning in a lateral impact. As shown in FIG. 1, the rearward portion of the fender panel 16 is secured to the rearward adjacent diaphragm by a fastener 104 and a plate 106. This plate 106 may have sides shaped to conform to the adjacent ridges 82, and forward and rearward edges that are beveled to reduce vehicle snagging. The plate 106 is relatively large, and can for example be 25 cm in length, and can define a lug extending downwardly into the respective slot 88. This arrangement provides a system in which the fender panels 16 telescope smoothly against one another in an axial collapse, and in which pull out of the fastener 104 is substantially prevented.

Figure 8:
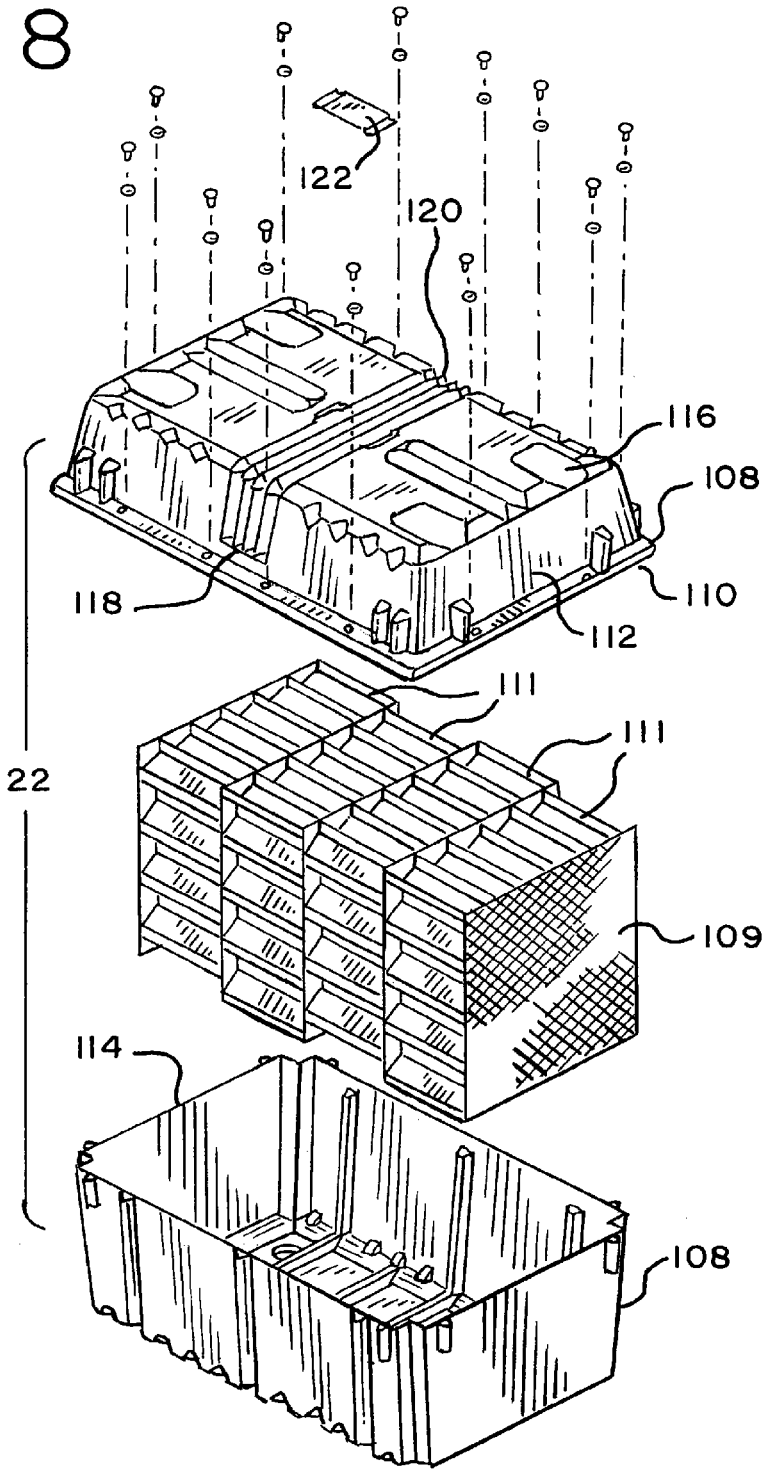
FIG. 8 is an exploded perspective view of an energy absorbing cartridge.

FIG. 8 shows an exploded view of one of the energy absorbing cartridges 22. This energy absorbing cartridge 22 includes an outer housing 108 that is formed in two parts that meet at a horizontally oriented seam 110. The housing defines front and rear surfaces 112, 114 that are positioned against the adjacent diaphragm assemblies 14. Each housing 108 also defines a respective top surface 116. The top surface 116 defines a zone of increased compressibility 118 that in this embodiment defines an array of parallel pleats or corrugations 120. These corrugations 120 extend generally parallel to the front and rear surfaces 112, 114. The zone of increased compressibility 118 ensures that in the event the housing 108 is compressed axially between the front and rear surfaces 112,114, this compression is initially localized in the zone 118. Simply by way of example, the housing 108 can have a length, height and width of about 82, 57, and 55 cm, and the zone 118 can have a width of about 11 cm. The housing 108 can be molded of any suitable material, such as linear, high or low density polyethylenes having, for example, an ultraviolet inhibitor. The housing 108 can contain any suitable energy absorbing components 109, and this invention is not limited to any specific configuration of components. For example, the energy absorbing components can be formed as described in U.S. Pat. No. 4,352,484, using a frangible paper honeycomb material (5 cm cell diameter and 5 cm layer thickness) and a polyurethane foam. Alternatively, the energy absorbing elements 109 can be formed as four frangible metal honeycomb elements 111, each 17.8 cm thick, with a cell diameter of 3.8 cm. The elements are preferably formed of low carbon, fully annealed steel sheets (0.45 mm thick in one element and 0.71 mm thick in the other three). In the embodiment of FIG. 1, the forward cartridge(s) 22, such as the cartridge 22 disposed in the nose compartment, may use the paper honeycomb material and the rearward compartments, such as the two bays may use cartridges 22 employing the steel material. However, it should be understood that the energy absorbing cartridge 22 is not limited to the above described embodiments, and any free-floating energy absorption device providing adequate energy absorption properties may be utilized in the compartments 2.

Because the cartridges 22 are frangible in one embodiment, it may difficult to permanently affix them in place within the compartments 2, for example in the nose compartment or in one of the bays 4. Moreover, because the cartridges 22 are designed to collapse as the nose compartment and the diaphragms 14 of the bays 4 compress and telescope in the rearward direction, it is preferable that the cartridges 22 do not remain fixed in place during impact and deformation. Accordingly, in one embodiment, the cartridges 22 are placed within the compartments 2, including the nose compartment and the bays 4, such that they are free from attachment to the frame, including the diaphragms and fender panels. In this embodiment, the lower surface of the cartridges 22 simply rests on supports that are disposed in each compartment 2. For example, the forwardmost cartridge 22 may rest on a shelf bracket 203 that is attached to a front surface of the forwardmost diaphragm 14 and on a shelf bracket 201 attached to the nose fender as shown in FIGS. 1, 11, 13 and 17. The cartridge 22 is not attached, however, to the nose fender 24 or other components in the nose compartment, but rather is simply supported thereby in the compartment. Likewise, in the bays 4, the cartridges 22 are not actually attached to the diaphragms 14, the fender panels 16, or the guide rail 12, but rather are supported in the compartments defined thereby. In other embodiments, the cartridges 22 may be frangibly attached to the frame by shear pins or the like that are designed to fail upon impact and allow the cartridges 22 to move in the rearward direction as the compartments 2 telescope and collapse during the impact event.

Embodiments utilizing cartridges 22 that are free from attachment the vehicle barrier 10 benefit from a simplified assembly process and repair/replacement process following an impact with a vehicle. However, because the cartridges 22 in these embodiments are not actually attached to the vehicle barrier 10, it is possible for the cartridge to shear or break-out of the compartments 2 during an impact. For example, the cartridge in the nose compartment may have a tendency to move in the vertical direction. This type of movement is partially mitigated in the nose compartment by the steel nose fender 24, which tends to crush and bend inward toward the center of the nose compartment, thereby providing a "gripping" effect on the frontal end of the foremost cartridge 22. However, absent the retaining device 3, it may be possible for the cartridge 22 to shift, rotate, or otherwise move in an upward direction during impact, which may cause the cartridge 22 to fracture and or protrude above the fender panels 16. If the entire cartridge 22 is no longer fully contained within the compartment 2, only part of the cartridge is actually exposed to the compressive impact forces and thus, only part of the total potential energy absorption of the cartridge 22 is utilized.

Thus, in such cases, the cartridge 22 is under-utilized during the vehicle impact and additional energy must then be absorbed by the remaining cartridges 22 disposed in the other compartments 2 (e.g., bays 4). In some circumstances, this under utilization of the energy absorption capacity of the cartridge(s) 22, and particularly the foremost cartridge 22 disposed in the nose compartment, may result in an inability of the overall vehicle barrier 10 to absorb an adequate or desired amount of energy. That is, if the foremost cartridge 22 does not absorb substantially its maximum potential amount of energy, the overall system becomes less efficient and the maximum defined energy absorbing capacity of the vehicle barrier 10 may be reduced. Thus, additional bays may have to be added to the vehicle barrier 10 in order to achieve a desired level of energy absorption, which leads to unnecessary cost and wasted resources.

Depending upon the application, the energy absorbing vehicle barrier 10 can have a varying number of compartments 2 defined by the frame. The frame is assembled from a plurality of diaphragm assemblies 14, fender panels 16, a guide rail and a nose fender 24. It should be understood that in other embodiments, the frame may be constructed of different components, which define the compartments. In the example shown in FIG. 1, the vehicle barrier includes three separate compartments 2: one nose compartment, and two bays 4. However, it should be understood that the vehicle barrier 10 is not limited thereto, and may include more than two bays 4, for example, and without limitation, five or more bays 4. For purposes of this specification, a bay 4 may describe a section of the energy absorbing vehicle barrier 10 comprising a pair of longitudinally spaced diaphragms 14, an energy absorbing cartridge 22, and two laterally spaced and longitudinally extending fender panels 16 disposed on opposite sides of the cartridge 22.

Figure 17:
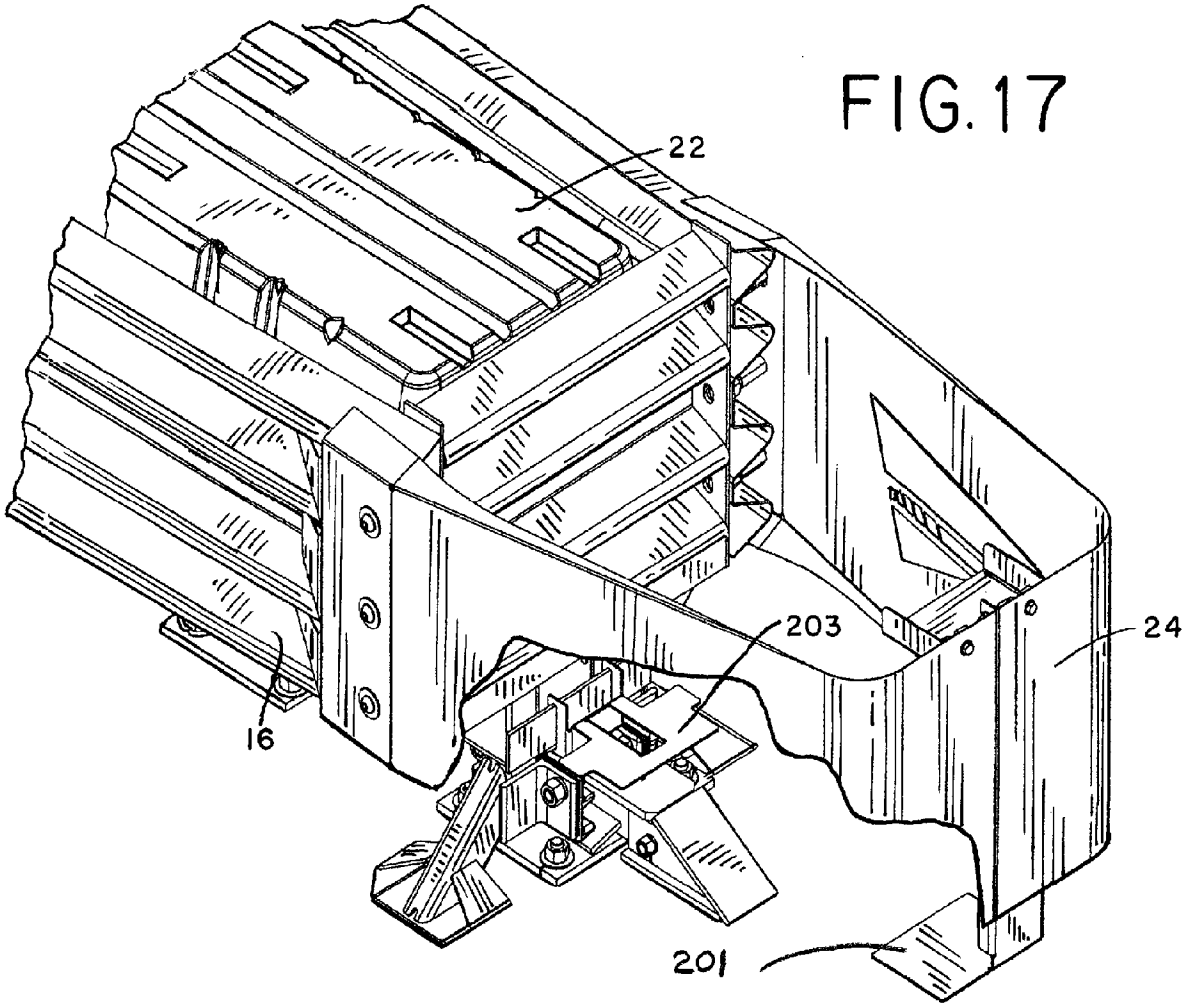
FIG. 17 is a partial cut-away view of the nose compartment without an energy absorbing cartridge disposed therein.

The nose compartment may include a nose fender 24 that wraps around a cartridge 22 and connects the fender panels disposed on opposite sides of the first bay 4. Alternatively, the nose fender 24 may connect two longitudinally extending fender panels 16 or other frame portions disposed on opposite sides of the cartridge 22. The nose fender 24 may be made from, for example, 14 gauge steel sheet, and may be formed from a single monolithic steel sheet or from two or more sheets connected by mechanical fasteners or the like, as shown in FIGS. 1 and 17. In other embodiments, the nose fender may be made, for example and without limitation, of other suitable materials, including other gauges of steel, other metals, such as aluminum, various plastics, composites, such as fiberglass, or various combinations thereof.

Figure 9:
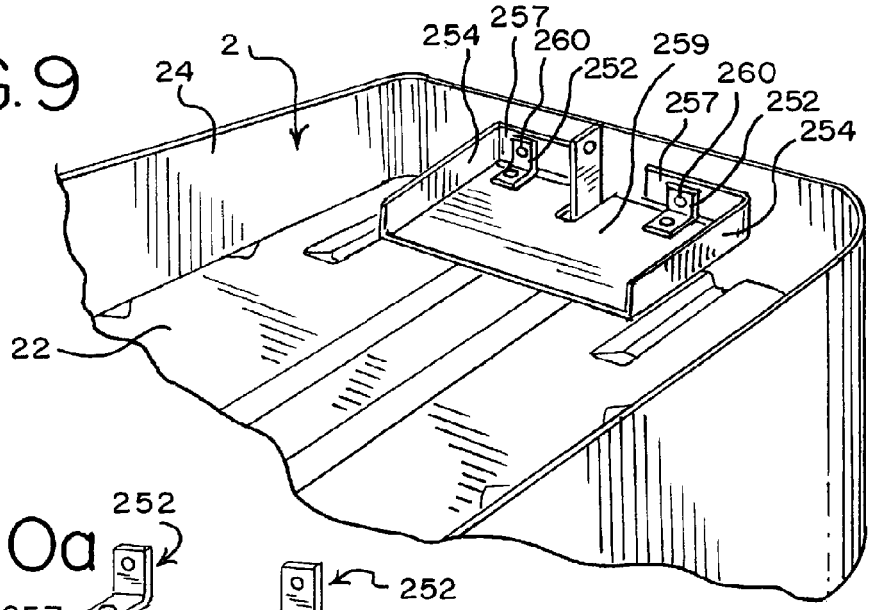
FIG. 9 is a partial enlarged view of the energy absorbing vehicle barrier shown in FIG. 1 configured with a retaining device.
Figure 10A:
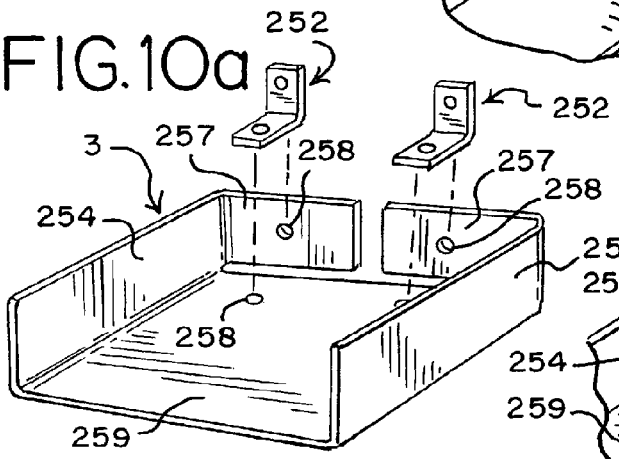
FIG. 10(*a*) is an exploded detail view of a retaining device.
Figure 10B:
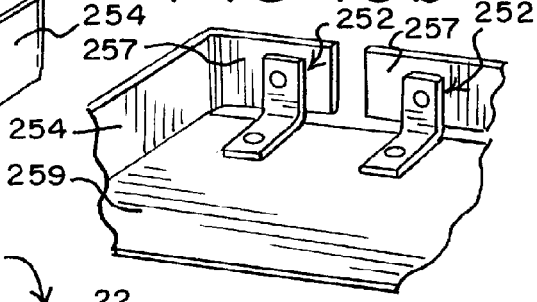

As shown in FIGS. 9 and 10(*a*)-(*b*), a retaining device 3 is attached to the nose fender 24. In one embodiment, the retaining device 3 is configured as a bracket having a box-like shape with a bottom surface 259 and two vertically extending upright walls 254 disposed on opposite ends thereof. A mounting flange 257 is formed as an extension of each of the upright walls 254, with each mounting flange 257 being bent inward toward a lateral center of the bracket to form a substantially right angle. The brace may be made from a single monolithic sheet of metal, i.e., as a flat pattern, that is bent into the above described shape, which results in a high strength design that is resistant to deformation when subjected to impact forces from a vehicle, particularly at the bent edges joining the upright walls 254 to the bottom surface 259 and at the joint between the upright walls 254 and the mounting flanges 257.

As shown in FIGS. 10(*a*) and (*b*), two "L-shaped" brace members 252 may be attached to the bracket by mechanical fasteners 23, welding, adhesives and the like, or combinations thereof. In one embodiment, the fasteners are inserted through attachment holes 258 disposed on the bottom surface 259 and on each of the mounting flanges 257. Although the retaining device may be used without the brace members, the brace members 252 act to strengthen the bracket at its attachment point, and in particular increase the bending strength of the retaining device. The bracket and the brace members 252 may be made from, for example and without limitation, of 10 gauge steel, such as ASTM A-36 or AISM 1020 steel. In other embodiments, the bracket and brace member may be made, for example and without limitation, of other suitable materials, including other gauges of steel, other metals, such as aluminum, various plastics, composites, such as fiberglass, or various combinations thereof. It should be understood that the bracket and/or brace members 252 may be made from any material that provides sufficient strength and may have any configuration that provides an adequately large contact surface to restrain and retain the energy absorbing cartridge 22 within the compartment 2 during impact with a vehicle, as will be described in more detail below.

The retaining device 3 may withstand 1000 lbs of static force evenly distributed under the bottom surface, while exhibiting only small areas where permanent deformation may take place. In actual crash tests, the bracket and brace member 252 combination of this embodiment of the retaining device 3 was found to be strong enough to largely avoid deformation during the impact event and was reusable in multiple full system capacity crash tests without being damaged.

Figure 11:
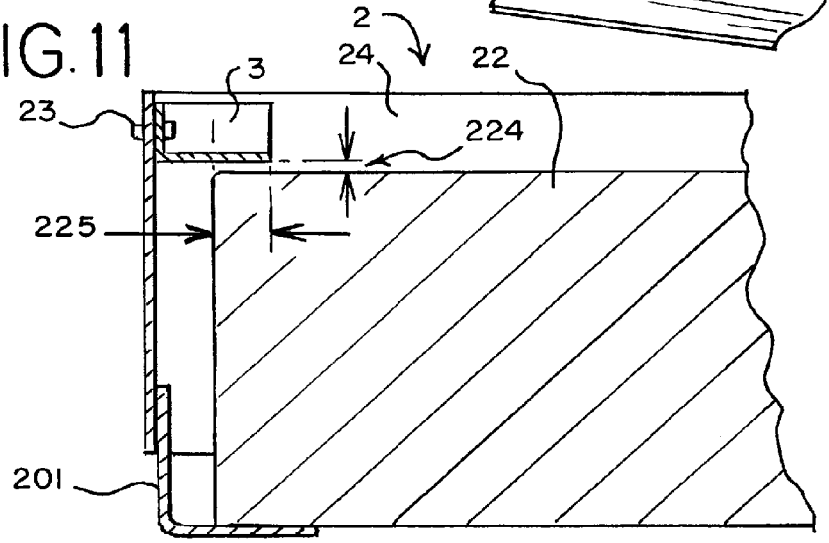
FIG. 11 is a side cross-sectional view of a nose compartment of the energy absorbing barrier.

As shown in FIGS. 9 and 11, the retaining device may be attached in a cantilevered manner over an upper surface of a front portion of the nose fender 24. In one embodiment, the retaining device is attached to a substantially flat surface of the nose fender. The bracket is attached such that a bottom surface 259 thereof is disposed above or at the same height as the upper surface of the cartridge 22. The bracket is preferably removably connected to the nose fender 24, for example with fasteners 23 or the like, such as pins or tabs. The bottom surface 259 of the bracket is preferably spaced above an upper surface of the energy absorbing cartridge 22 such that at least a minimal gap 224 is formed therebetween. This gap 224 allows the retaining device 3 to be mounted to the nose fender 24 without interference caused by tolerance/thickness buildup, thereby simplifying the manufacturing, assembly, and replacement processes. The bottom surface 259 of the bracket extends longitudinally in a cantilevered manner in the rearward direction over at least a portion of the cartridge 22 in an overlapping manner. The bracket may overlap with the cartridge 22 by an amount 225, which may range from, for example, three (3) inches or more, which on one embodiment of a 32 inch compartment, provides approximately 10% overlap. Note that while the bracket is shown as only extending over a portion of the lateral width of the cartridge 22, it is not limited thereto and the bracket may span the entire width, and longitudinal length of the cartridge 22. Further, it should be understood that the bracket may be attached to the nose fender 24 with or without the braces 259. In one alternative embodiment, the retaining device extends substantially over the entire longitudinal length, wherein it is secured to the nose fender on one end and a diaphragm member on the other. Although the retaining device is disclosed as being installed in the compartment defined by the nose fender, it should be understood that similar retaining devices may be used in the other compartments defined as bays.

Figure 15:
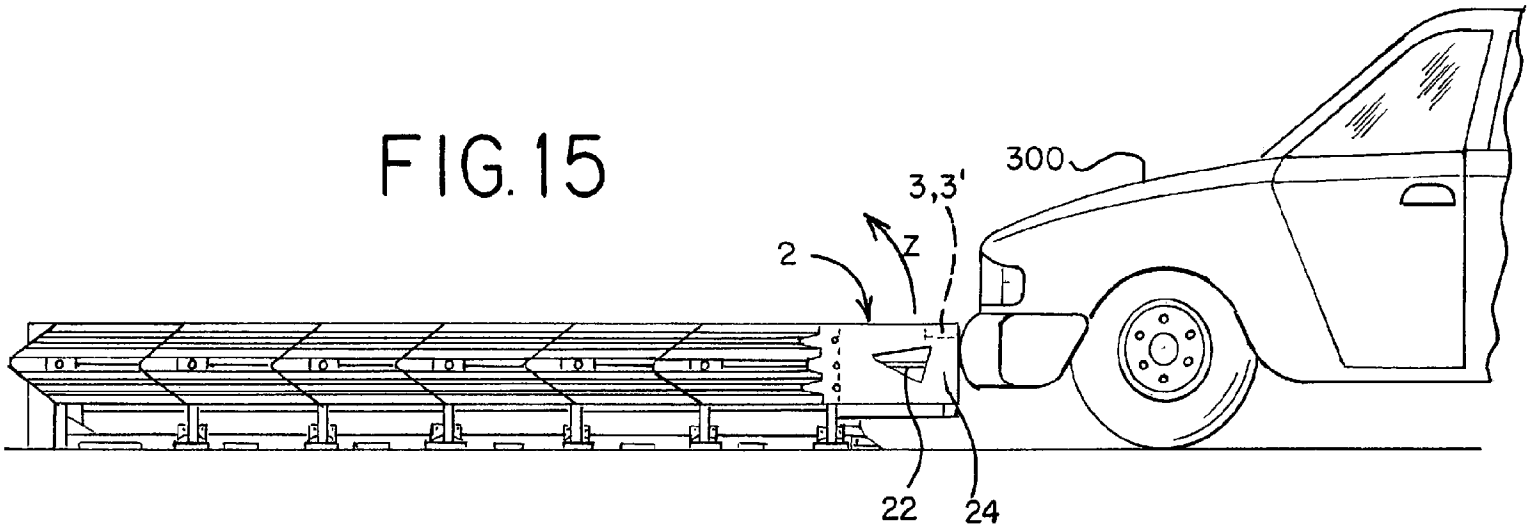
FIGS. 15-16 illustrate an energy absorbing vehicle barrier attenuating a vehicle during the initial stages of impact.
Figure 16:
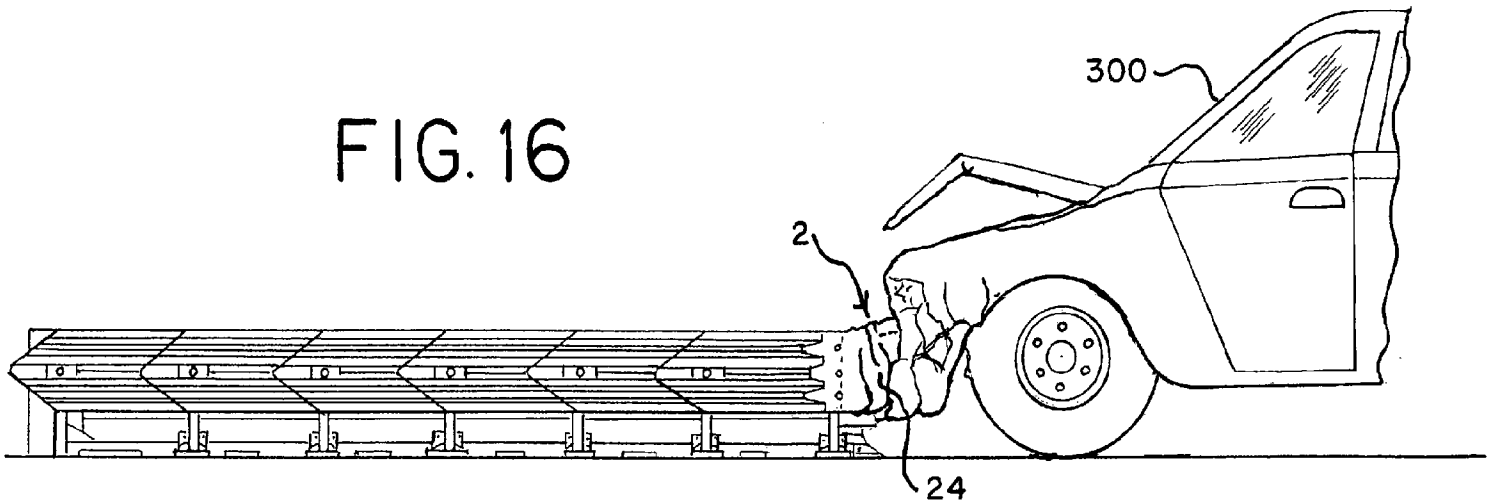

As shown in FIGS. 15 and 16, the retaining device 3 is provided to retain and restrain the cartridge 22 during impact, and prevent under utilization of the energy absorbing properties of the cartridge 22. As set forth above, the retaining device 3 is disposed above at least a portion of the upper surface of the cartridge 22 such when the compartment 2 is impacted, that the bottom surface 259 acts as a reaction surface against the upper surface of the cartridge 22, thereby substantially preventing the cartridge 22 from rotating or moving in at least the vertical direction Z. By preventing the cartridge 22 from rapidly moving upward in the Z direction, the cartridge 22 is not exposed to direct impact with, for example, a bumper of the vehicle 300, which could cause the cartridge to fracture or shear off. Moreover, because the cartridge 22 remains within the compartment 2, substantially the entire cartridge 22 is subject to the compressive impact force. Thus, the cartridge 22 is able to absorb substantially the maximum amount of energy absorption from the impact.

Further, because the cartridge 22 remains contained in the compartment 2, the nose fender 24 is also less likely to bend away from the fender panels and increase torque on the system. Since the nose fender 24 does not bend away during impact, the nose fender 24 helps to guide the front of the vehicle 300 directly into the center of the vehicle barrier 10, thereby maximizing the energy absorption of each of the cartridges 22.

Figure 12:
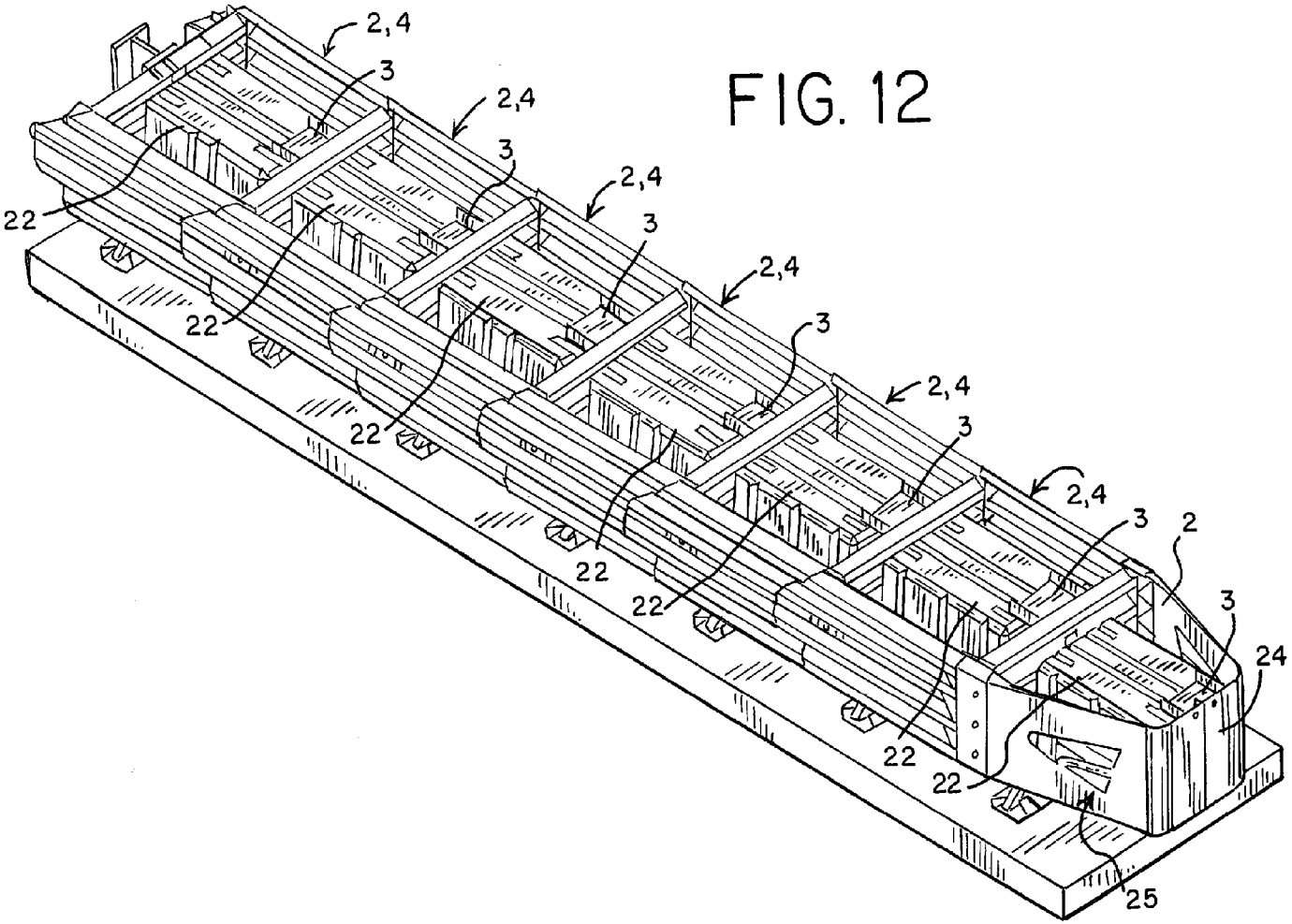
FIG. 12 is a perspective view of another embodiment of an energy absorbing vehicle barrier.
Figures 13, 14:
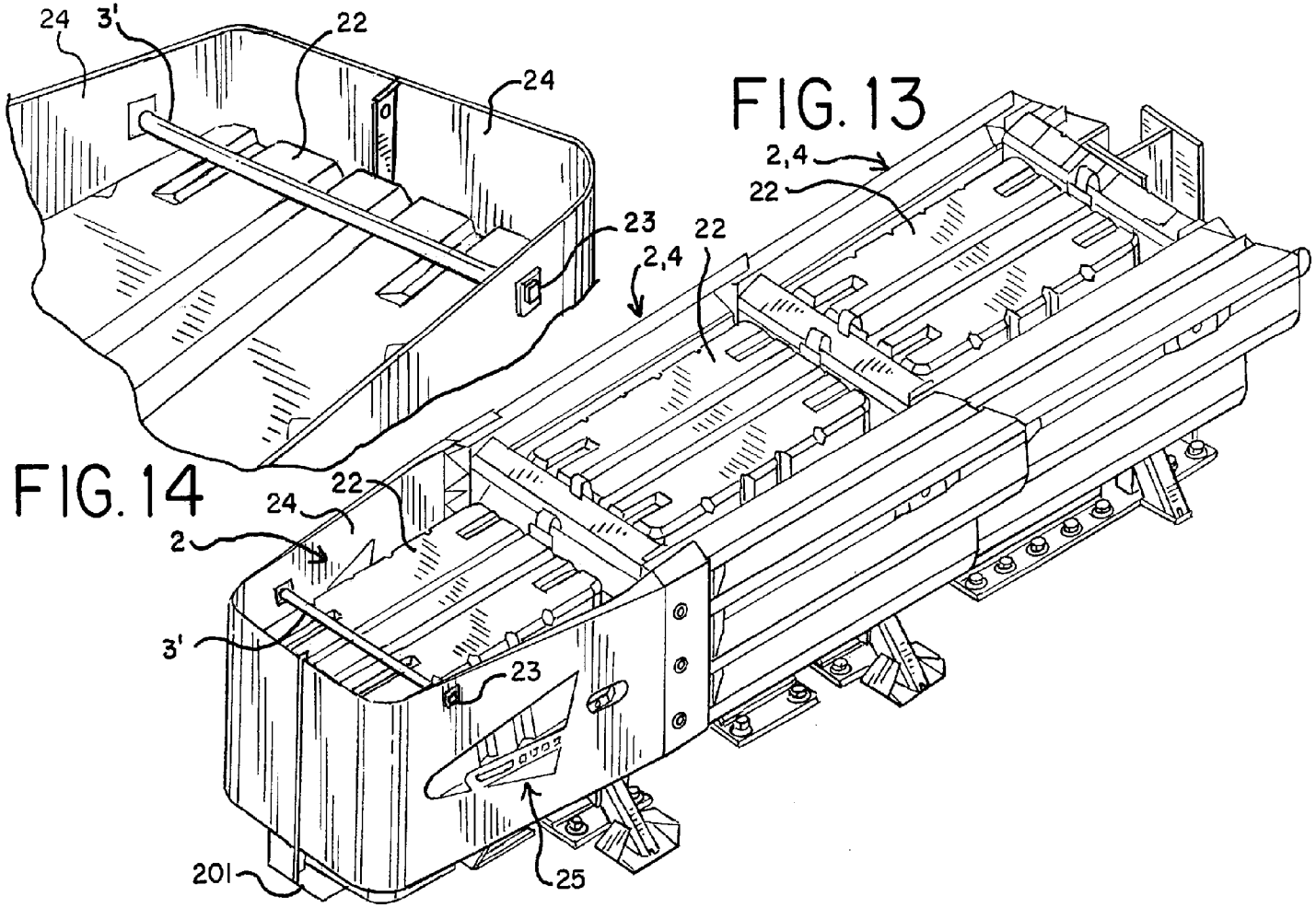
FIG. 13 is a perspective view of another embodiment of an energy absorbing vehicle barrier.
FIG. 14 is a partial enlarged view of one embodiment of the energy absorbing vehicle barrier configured with an alternative embodiment of a retaining device.

FIG. 12 illustrates another embodiment of the energy absorbing vehicle barrier 400, in which a retaining device 3 is attached to each of the compartments 2, including the nose compartment and all six bays 4. While the retaining device 3 is shown as the bracket of FIGS. 9-11, it is not limited thereto. For example, as shown in FIGS. 13 and 14, the retaining device may be configured as a bar 3' or other like cross member. The bar 3' may be replaceably attached to opposing sides of the nose fender 24 by mechanical fasteners or the like, and may extend across an entire lateral width of the cartridge 22. Similarly, the bar 3' may also extend across the bays 4, and be replaceably attached to opposing fender panels 16. It should be understood that the bar retaining device 3' may also be used in the embodiment 10 of FIGS. 1-11.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An energy absorbing vehicle barrier, comprising:

a frame defining a compartment and comprising a laterally extending component, wherein said frame is collapsible in a longitudinal direction from a first configuration to a second configuration in response to a vehicle impact;

an energy absorbing cartridge disposed within said compartment, wherein said energy absorbing cartridge is engageable and deformable in said longitudinal direction by said laterally extending component of said frame from an initial configuration to an impact configuration in response to said frame collapsing in said longitudinal direction from said first configuration to said second configuration; and a rigid retaining device coupled to said frame, said retaining device being disposed above and extending over at least a portion of an upper surface of said cartridge;

wherein said retaining device is adapted to contact and engage said upper surface of said cartridge in response to said vehicle impact, said retaining device adapted to remain rigid during said vehicle impact and thereby substantially prevent movement of said cartridge in a vertical direction during said vehicle impact as said energy absorbing cartridge is deformed by said frame from said initial configuration to said impact configuration.

2. The energy absorbing vehicle barrier of claim 1, wherein said retaining device is free of any attachment to said cartridge.

3. The energy absorbing vehicle barrier of claim 1, wherein said cartridge is removably supported by said frame.

4. The energy absorbing vehicle barrier of claim 1, wherein said cartridge is frangible.

5. The energy absorbing vehicle barrier of claim 4, wherein at least a portion of a bottom side of said frangible cartridge is supported by said frame and said cartridge is substantially free from attachment to said frame.

6. The energy absorbing vehicle barrier of claim 1, wherein said laterally extending component of said frame comprises a nose defining said compartment.

7. The energy absorbing vehicle barrier of claim 1, wherein first and second ends of said retaining device are coupled respectively to opposite sides of said frame, wherein said retaining device extends laterally above said cartridge across an entire width thereof.

8. The energy absorbing vehicle barrier of claim 7, wherein said retaining device comprises a bar releasably coupled to said frame.

9. A method of arresting a vehicle, said method comprising:

providing an energy absorbing vehicle barrier, said vehicle barrier comprising at least one frame defining a compartment having a laterally extending component; an energy absorbing cartridge disposed within said compartment; and a rigid retaining device coupled to said frame, said retaining device being disposed above and extending over at least a portion an upper surface of said cartridge;

impacting said barrier in a longitudinal direction with said vehicle;

collapsing said frame in said longitudinal direction in response to said impacting said barrier with said vehicle;

engaging and deforming said energy absorbing cartridge in said longitudinal direction with said laterally extending component of said collapsing frame; and restraining said cartridge in at least a substantially vertical direction with said retaining device during said impacting said barrier with said vehicle and said deforming said energy absorbing cartridge with said collapsing frame without substantially deforming said retaining device, said retaining device and said frame thereby substantially retaining said cartridge within said compartment during said impacting said barrier with said vehicle and said deforming said energy absorbing cartridge with said collapsing frame.

10. The method of claim 9, wherein, when said vehicle barrier is impacted with a force greater than or equal to a maximum absorption force capable of being absorbed by said cartridge, said cartridge absorbs substantially the entire maximum absorption force.

11. The method of claim 9, wherein first and second ends of said retaining device are coupled to opposite sides of said frame, wherein said retaining device extends laterally above said cartridge and substantially across an entire width thereof.

12. The method of claim 11, wherein said retaining device comprises a bar releasably coupled to said frame.

13. The method of claim 9, wherein at least a portion of a bottom side of said cartridge is supported by said frame and said cartridge is substantially free from attachment to said frame.

14. The method of claim 9 wherein said retaining device is free of any attachment to said cartridge.

15. A method of assembling an energy absorbing vehicle barrier, said method comprising:

assembling a frame to define at least one compartment, said frame having at least two opposing sides extending in a longitudinal direction thereof and a laterally extending component extending between and coupled to said sides, wherein said frame is collapsible in a longitudinal direction from a first configuration to a second configuration in response to a vehicle impact;

placing a cartridge within said compartment, wherein said cartridge is engageable and deformable in said longitudinal direction by said laterally extending component of said frame from an initial configuration to an impact configuration in response to said frame collapsing in said longitudinal direction from said first configuration to said second configuration; and attaching a rigid retaining device to said frame above an upper surface of said cartridge, said retaining device adapted to remain rigid during said impact and thereby substantially prevent movement of said cartridge in a vertical direction during said impact as said energy absorbing cartridge is deformed by said frame from said initial configuration to said impact configuration.

16. The method of claim 15, wherein said placing said cartridge in said compartment comprises supporting at least a portion of a bottom side of said cartridge with said frame wherein said cartridge is substantially free from attachment to said frame of said compartment.

17. The method of claim 15 wherein said attaching said retaining device to said frame is performed after said placing of said cartridge in said compartment.

18. The method of claim 15 further comprising maintaining said retaining device free of any attachment to said cartridge.

19. The energy absorbing vehicle barrier of claim 1, wherein said frame defines a plurality of compartments and comprises a plurality of laterally extending components, and further comprising a plurality of said energy absorbing components disposed in corresponding ones of said plurality of compartments, wherein said plurality of energy absorbing components are engageable and deformable in said longitudinal direction by respective ones of said plurality of laterally extending components in response to said frame collapsing in said longitudinal direction from said first configuration to said second configuration.

20. The method of claim 9, wherein said frame defines a plurality of compartments and comprises a plurality of laterally extending components, and further comprising a plurality of said energy absorbing components disposed in corresponding ones of said plurality of compartments, wherein said engaging and deforming said energy absorbing cartridge with said laterally extending component of said collapsing frame comprises engaging and deforming said plurality of energy absorbing components in said longitudinal direction with respective ones of said plurality of laterally extending components in response to said collapsing said frame.

21. The method of claim 15, wherein said frame defines a plurality of compartments and comprises a plurality of laterally extending components, and further comprising a plurality of said energy absorbing components disposed in corresponding ones of said plurality of compartments, wherein said plurality of energy absorbing components are engageable and deformable in said longitudinal direction by respective ones of said plurality of laterally extending components in response to said frame collapsing in said longitudinal direction from said first configuration to said second configuration.

* * * * *